United States Patent [19]

Evans

[11] Patent Number: 4,478,295

[45] Date of Patent: Oct. 23, 1984

[54] TUNED SUPPORT FOR CUTTING ELEMENTS IN A DRAG BIT

[76] Inventor: Robert F. Evans, 631 Honeywood La., La Habra, Calif. 90631

[21] Appl. No.: 422,592

[22] Filed: Sep. 24, 1982

Related U.S. Application Data

[63] Continuation-in-part of Ser. No. 214,216, Dec. 8, 1980.

[51] Int. Cl.[3] ..... E21B 10/00

[52] U.S. Cl. ..... 175/56; 175/391; 175/409

[58] Field of Search ..... 175/56, 391, 394, 409, 175/410, 411

[56] References Cited

U.S. PATENT DOCUMENTS 3,101,934 8/1963 Poundstone ..... 175/410

FOREIGN PATENT DOCUMENTS 400487 3/1974 U.S.S.R. ..... 175/391
622961 7/1978 U.S.S.R. ..... 175/403
623959 7/1978 U.S.S.R. ..... 175/410

OTHER PUBLICATIONS

*World Oil*, Jan. 1977, pp. 109–112, Particularily p. 112, 1st column, Daniel R. Sabre, "Superhard Materials Promise Extended Wear Capability".

*Primary Examiner*—Stephen J. Novosad
*Assistant Examiner*—Michael Starinsky
*Attorney, Agent, or Firm*—John R. Ley

[57] ABSTRACT

Harmonic resonation of cutting elements against the earth formation is impeded in a rotary drag-type drill bit by providing connection means which yieldably and resiliently support the cutting elements from the drill bit but which deflects or vibrates with different natural resonant harmonic frequencies. The different natural harmonic frequencies tend to cancel or nullify resonance of any one of the connection means. The connection means can also be externally damped against vibrational movement.

10 Claims, 3 Drawing Figures

TUNED SUPPORT FOR CUTTING ELEMENTS IN A DRAG BIT

This is a continuation-in-part application of U.S. patent application Ser. No. 214,216 for "Drill Bit With Yielding Support and Force Applying Structure for Abrasion Cutting Elements", filed by the inventor hereof on Dec. 8, 1980.

The present invention pertains to a new and improved means for and method of advantageously connecting cutting elements to a drag type drill bit for the purpose of reducing breakage and the magnitude of destructive forces on the cutting elements resulting from harmonic bounce or chatter and for the purpose of maintaining greater drilling contact with the earth formation.

The typical rotary drag drill bit such as that used in the production of oil, gas and other natural resources employs a plurality of abrasion cutting elements which are rigidly connected or bonded to the body of the drill bit. The drill bit body is, of course, rigidly connected at the bottom end of a series of rigidly connected steel pipes forming a drill string. Rotation of the drill string rotates the abrasion cutting elements against the earth formation at the hole bottom and shears or abrades away particle cuttings from the earth formation to advance the well bore. The earth formation at the hole bottom usually possesses characteristic differences in hardness and may fracture, break or cut with different resistive forces from one point to the next, thus leaving uneven and somewhat protruding areas on the hole bottom. This unevenness transmits shock or intermittent energy to the drill bit as it is rotated. Since a long drill string of steel pipe has elastically deflectable spring-like characteristics, the energy transmitted to the bit excites the drill string and may create a resonant bounce or chatter of the bit on the hole bottom. It has been shown that, under certain conditions, the bit bounces totally out of contact with the hole bottom drill face only to collide with the rough bottom on its return at the lower extension of the drill string.

Abrasion cutting elements are subject to rapid deterioration and breakage as a result of large intermittent shock forces created by bit chatter or bounce. Although abrasion cutting elements possess great resistance to wear in the direction of normal abrasion or cutting attack, the bit chatter forces are in a different direction and cause the premature wear and breakage.

The aforementioned previous invention of the Applicant herein and U.S.S.R. Pat. Nos. 548,701 (1977) and 622,961 (1978) disclose abrasion cutting elements yieldably connected to a drag bit. As discussed in the previous application of the present inventor, one reason for yieldably connecting the abrasion cutting elements to the drag bit is to allow them to yield somewhat under the influence of the intermittent shock loads. It is believed, however, that by yieldably connecting the abrasion cutting elements to the bit body with a deflectable connection structure, it is possible to actually amplify the chatter under circumstances where the connection structure commences harmonic vibration due to exitation forces from the uneven borehole bottom. Destructive results can occur rapidly after the onset of harmonic chatter.

INVENTION SUMMARY

The present invention pertains to yieldably connecting cutting elements to a drag bit to minimize the destructive forces on the cutting elements associated with harmonic bounce or chatter, and to avoid amplifying and reinforcing the bounce or chatter. As a result, the abrasion cutting elements of the bit maintain cutting contact with the earth formation a greater part of the time to increase drilling effectiveness, and the abrasion cutting elements experience reduced breakage to increase the effective usable lifetime of the drill bit.

In accordance with its broad aspects, the present invention pertains to a rotary drag drill bit having a plurality of cutting elements which are operatively yieldably and resiliently deflectably supported from a body portion of the bit by connection means capable of vibrational movement. The connection means supporting one group of cutting elements has a natural harmonic resonant frequency which is different than the natural harmonic resonant frequency of the connection means supporting at least one other group, and preferably all of the other groups, of cutting elements. The different natural harmonic frequencies of the connection means tend to cancel or nullify the tendency for continued reinforcement of harmonic vibration of any one connection means, and any nonreinforced vibration is inherently damped by energy absorption characteristics of the connection means. Each of the connection means can further be damped against vibration by external vibrational damping means operatively extending between at least two of the connection means. The vibrational damping means further tends to nullify harmonic resonation by preventing reinforcement of the vibration.

The nature and details of the present invention can be more completely understood by reference to the following description of a preferred embodiment taken in conjunction with the drawings, and from the appended claims.

DRAWINGS

PREFERRED EMBODIMENT

Figure 1:
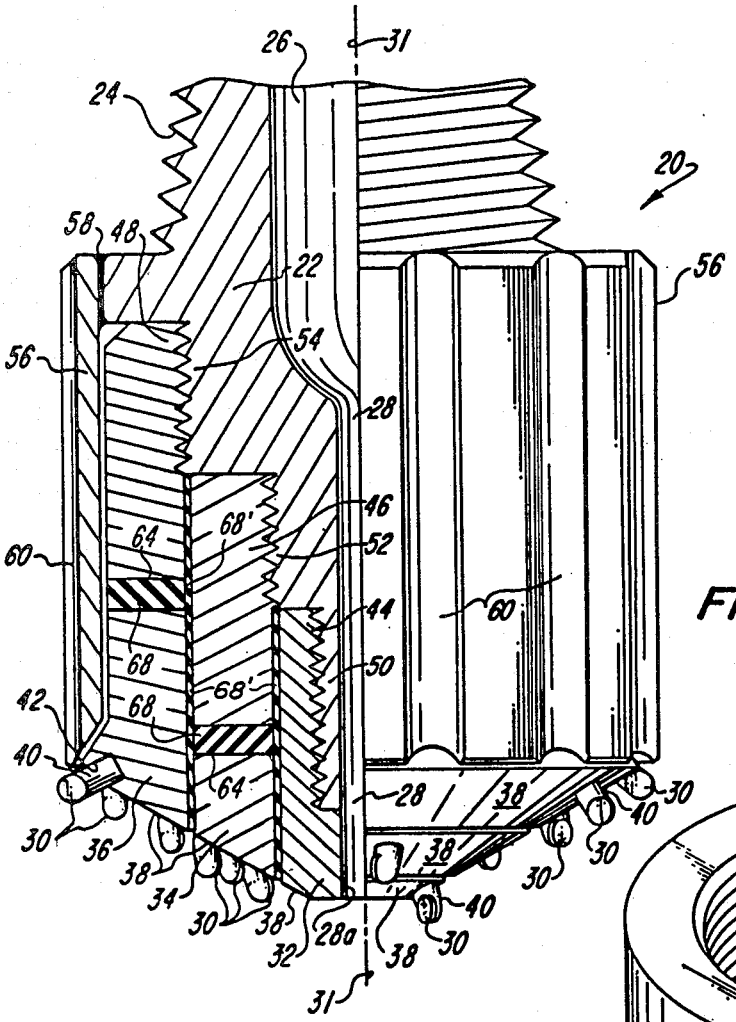
FIG. 1 is a side elevational view of a rotary drag bit embodying one form of the present invention, with the left-hand half vertically sectioned along an axis thereof to illustrate a tuned supporting arrangement for cutting elements thereof.
Figure 2:
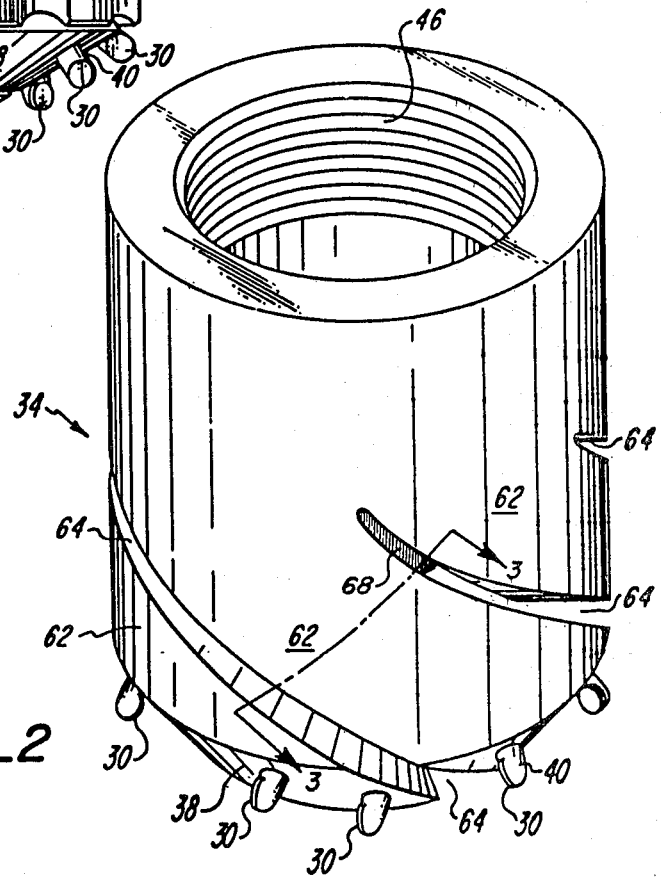
FIG. 2 is a perspective view of a sleeve element of the drill bit illustrated in FIG. 1.

The embodiment of the present invention shown in FIGS. 1 and 2 is particularly useful in conjunction with a rotary drag bit 20. The drag bit 20 comprises a main body structure 22 having a threaded end 24. Lengths of drill pipe (not shown) comprising the drill string are threadably connected to the bit 20 at the threaded end 24. A drilling fluid passageway 26 extends axially into the body structure 22. A reduced size axial passageway 28 extends from the drilling fluid passageway 26 to the lowermost end of the bit 20. The passageway 28 defines a drilling fluid expulsion nozzle through which pressurized drilling fluid is expelled in a jet on the drill face of the well bore cut by the bit 20. Of course, the expelled drilling fluid lifts the particle cuttings removed by the drill bit and transports them out of the well bore through the annulus between the drill string and the sidewalls of the well bore.

A plurality of abrasion cutting elements 30 are operatively connected to the body 22 of the bit 20. The abrasion cutting elements 30 contact and cut the earth formation in a shearing or abrading circular motion path when the bit 20 is rotated about its axis 31 by rotating the drill string. The abrasion cutting elements 30 are preferably of the natural or synthetic or diamond material type. Diamond material cutting elements are highly abrasive and highly resistive to wear in a shear cutting mode. One example of a well known synthetic diamond material abrasion cutting element is disclosed in U.S. Pat. No. 4,156,329. Synthetic cutting elements are commercially available from General Electric under the trademark STRATAPAX.

A plurality of different diameter cylindrical sleeve members, e.g., 32, 34 and 36, are operatively connected to the body structure 22 at different radially outward spaced positions concentric about the bit axis 31. The abrasion cutting elements 30 are rigidly connected to extend from a lower surface 38 of each of the concentric sleeve members. The abrasion cutting elements are connected to the sleeve members in the typical manner. U.S. Pat. No. 4,006,788 describes a typical manner of attachment of the abrasion cutting elements. In general, however, the abrasion cutting element 30 is attached to a slug 40, and the slug 40 is bonded within a correspondingly-shaped opening 42 extending into each sleeve member from its lower surface 38. As is shown in FIG. 1, the radially inwardmost sleeve member 32 may include a passageway 28a formed therethrough for the purpose of extending the passageway 28 in the body structure and for the purpose of defining a nozzle orifice for the expulsion of the pressurized drilling fluid.

Preferably, each of the sleeve members, e.g., 32, 35 and 36, is removably connected to the body structure 22. In the embodiment shown in FIG. 1, upper threaded ends 44, 46 and 48 of the sleeve members 32, 34 and 36 are threaded onto threaded stepped shoulders 50, 52 and 54 of the body structure 22, respectively. The threaded stepped shoulders 50, 52 and 54 are positioned at different radial locations which correspond with the upper threaded ends of each sleeve member according to its diameter. Similarly, the axial location of the threaded stepped shoulders 50, 52 and 54 is determined in accordance with the length of each sleeve member between the lower surface 38 and its upper threaded end, to position the lower surfaces 38 and cutting elements 30 in a desired cutting configuration and profile. In addition to the threaded connection means for removably attaching each sleeve member to the bit body structure, other types of sleeve members can be welded or otherwise bonded to the stepped shoulders. Repair, rebuilding and replacement of the sleeve members and their attached abrasion cutting elements 30 is facilitated by removably connecting the sleeve members to the body structure. Convenient access to those parts in need of repair or replacement is achieved by removing one or more of the sleeve members. New sleeve members with fresh cutting elements can be readily attached to the bit body, rather than discarding the whole bit if only a portion of its elements have failed. Replacement of the abrasion cutting elements and their attachment slugs is more easily accomplished with the sleeve members removed from the drill bit.

An outer cover and protection sleeve 56 is also attached at the radial outward position of the body structure 22. Preferably, the protection sleeve 56 is integral with the bit structure 22 or is bonded thereto by a weld at 58. A plurality of axially extending grooves 60 are formed in the outer surface of the protection sleeve 56. The grooves 60 define upward extending passageways through which the drilling fluid and the particle cuttings are carried by the drilling fluid flow upward away from the drill face of the well bore. The protection sleeve 56 also protects the radially outermost sleeve member 36 from contacting the sidewall of the well bore and from the influences of the drilling fluid flowing therepast.

In order to operatively support and connect each of the abrasion cutting elements 30 from the drill bit 20 in a manner which allows the abrasion cutting element to yield axially under the application of shock loads and locally concentrated forces, but which will apply optimum force to the abrasion cutting elements to achieve the best cutting effects, the lowermost portion of each sleeve member is defined into a plurality of separate ribbon members 62. As is shown in FIG. 2, the lower portion of the sleeve member 34 is defined into the ribbon portions 62 by helical slots 64 formed completely through the sidewall of the sleeve member. As a result, each of the ribbon portions 62 is generally helically extending and separate from one another, but the whole of the ribbon portions still retains the general configuration of a cylindrical sleeve. After forming the ribbon portions 62, the metal material, typically steel, of each sleeve member is subjected to known metallurgical treatments which create a spring temper in each of the ribbon portions 62. Each of the ribbon portions thereby take on the characteristics of a helically extending leaf spring cantileverly supported at its upper end from the upper portion of the sleeve member. Of course, a group of abrasion cutting elements 30 (one or more) is operatively connected to the lower surface 38 of each ribbon portion 62 between the slots 64.

The application of weight to the drill bit 20 is transferred through the ribbon portions 62 to the abrasion cutting elements 30. The cutting elements 30 are forced into the earth formation being drilled. Under the influence of intermittent shock forces or localized concentrated areas of force, one or more of the ribbon portions 62 of one or more of the sleeve members, 32, 34 or 36, will deflect under the influence of the force and prevent or significantly reduce the potentially damaging effects of intermittent or locally concentrated forces on the cutting elements 30. Under normal cutting conditions, the ribbon portions 32 deflect until the predetermined desired operational force or weight on the drill bit is applied to the abrasion cutting elements. In this manner, the optimum cutting force from the abrasion cutting elements to the earth formation is maintained while protecting against intermittent shock and locally concentrated axial forces.

At least two, and preferably all, of the cantileverly supported spring leaf ribbon portions 62 are caused to have a different frequency of natural vibration, by the arrangement of the helical slots 64 formed through each of the sleeve members. It is known that a rectangular cross section cantileverly supported beam has a natural resonant or harmonic frequency which is related to its length and its depth. For example, see *Kent's Mechanical Engineer's Handbook,* page 9-03, Design and Production Volume, 12th Edition, John Wiley & Sons, Inc.

Figure 3:
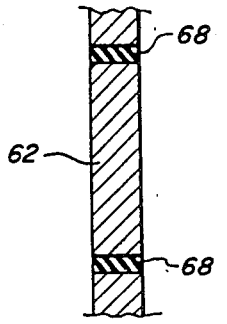
FIG. 3 is a section view taken substantially in the plane of line 3—3 through a spring leaf of the sleeve element shown in FIG. 2.

Each of the ribbon portions 62 is of rectangular cross section, as is illustrated in FIG. 3. The length of each ribbon portion 62 is related to the length from the lower surface 38 to the uppermost ends of the slots 64. The depth of each ribbon member 62 is the width or transverse thickness shown in FIG. 3. By varying the length of the slots 64 and the circumferential space between slots 64, ribbon portions 62 of different effective lengths and depths are achieved. Different natural resonant frequencies for vibration are thereby created.

At least two, and preferably all, of the ribbon portions 62 of all the various sleeves, 32, 34 and 36, are structured or "tuned" to have a different natural harmonic resonant frequency. Shock forces applied to the leaf spring ribbon portions 62 do not, therefore, tend to create a similar harmonic resonance in all of the ribbon portions 62. Furthermore, since excitation of one of the leaf spring ribbon portions will not excite or reinforce vibration in other ribbon portions, there is no tendency for amplification or reinforcement of vibration. Instead, the vibration from any particular leaf spring ribbon portion tends to cancel the vibrations in other leaf spring ribbon portions. Intermittent shock forces transferred to particular leaf spring ribbon portions are not harmonically magnified, amplified or reinforced by the characteristics of other leaf spring ribbon portions. In essence, the drill bit as a whole is "detuned" or made substantially nonreceptive to natural harmonic resonation. As a consequence, shock force energy is quickly absorbed or inherently damped by each of the spring leaf ribbon portions before harmonic chatter can build to a substantial destructive extent.

To further dampen the leaf spring ribbon portions 62 against bouncing or chattering the cutting elements against the well borehole bottom, exterior frictional dampening material 68, such as rubber, may be inserted between the sleeves 32, 34 and 36, as shown in FIG. 1. The dampening material 68 absorbs and dissipates vibrational energy from the leaf spring ribbon portions 62. By dampening vibrational energy in this manner, the tendency to resonate or vibrate is further reduced. As shown in FIGS. 2 and 3, dampening material 68' may also be inserted in the helical slots 64. The dampening material may be bonded to the sleeves 32, 34 and 36 during assembly, and can be bonded in the helical slots 64 after each of the sleeves 32, 34 and 36 has been machined. FIG. 2 illustrates the rubber 68 only partially filling one of the slots 64, but the rubber could completely or partially fill any or all of the slots.

The drilling penetration rate of the drag bit 20 should increase, because the abrasion cutting elements should maintain cutting contact with the earth formation a greater part of the time. Since there is a reduced tendency for the leaf spring ribbon portions 62 to vibrate or chatter, the leaf spring ribbon portions force the abrasion cutting elements into cutting contact with the earth formation more continuously than occurs when harmonic oscillations cause the abrasion cutting elements to bounce or chatter into and out of contact with the earth formation at the well bore bottom. Furthermore, since the abrasion cutting elements are in a more continuous contact with the earth formation, they are subject to reduced shock forces, since they are not bouncing or chattering. A reduction in shock forces prolongs the lifetimes of the cutting elements and increases effective bit life. By increasing the effective bit life, the cost of drilling well bores is significantly reduced, since a substantial amount of the drilling cost is involved in "tripping" to replace broken or worn drill bits. "Tripping" is the process of lifting the drill string out of the well bore by detaching the pipe lengths one at a time to gain access to the drill bit. Tripping is a very time consuming process which is nonproductive from the standpoint of advancing the well bore.

The preferred embodiment of the present invention has been shown and described with a degree of particularity. It should be understood, however, that the specificity of the present description is by way of example and that the invention is defined by the scope of the appended claims.

What is claimed is:

1. In a rotary drag drill bit having a plurality of cutting elements, the plurality of cutting elements divided into a plurality of separate groups of at least one cutting element in each group, the drill bit having a body portion adapted to be connected to a drill string, at least one sleeve member connected to the body portion and positioned generally coaxially about a rotational axis of said bit, each sleeve member connected at one axial end thereof to the body portion, the sleeve member extending from the one axial end thereof to the other axial end thereof, each sleeve member divided into a plurality of ribbon portions separated by adjacent slots formed through the sleeve member and extending from the other axial end toward the one axial end, the cutting elements of each group connected to a ribbon portion at the other axial end of the sleeve member, and an improvement in combination therewith wherein:

each ribbon portion has resilient and spring-like characteristics to resiliently yield under the influence of shock loads and to vibrate at a predetermined natural harmonic frequency when excited, and at least one ribbon portion is operatively structured to create a natural harmonic vibrational frequency thereof which is substantially different than the natural harmonic vibrational frequency of any other ribbon portion.

2. In the drag bit recited in claim 1, the slots and the ribbon portions are helical.

3. In the drag bit recited in claim 1, at least one sleeve member is removably connected to the drill bit.

4. In the drag bit recited in claim 1, the improvement further comprises vibrational damping means extending between the two ribbon portions.

5. In the drag drill bit recited in claim 1:

the predetermined frequency of natural harmonic vibration of each ribbon portion is substantially different than the predetermined frequency of natural harmonic vibration of any of the other ribbon portions

6. In the drag bit recited in claim 1, wherein the improvement further comprises:

damping means connected to the ribbon portions and operative for damping vibrational energy from the ribbon portions tending to cause harmonic resonance of said ribbon portions.

7. In the drag bit recited in claim 6 wherein a plurality of sleeve members are connected to the body portion and each sleeve member is divided into a plurality of said ribbon portions, and wherein the improvement further comprises:

damping means connected to each of said ribbon portions.

8. In the drag bit recited in claim 7, the vibrational damping means substantially occupies an annular space between the ribbon portions of concentrically adjacent sleeve members.

9. In the drag bit recited in claim 8, the vibrational damping means also substantially occupies the space defined by the slots in each sleeve member.

10. In the drag bit recited in claims 8 or 9, the vibrational damping means comprises friction rubber material.

* * * * *